US005533830A

United States Patent [19]

Barichello

[11] Patent Number: 5,533,830

[45] Date of Patent: Jul. 9, 1996

[54] FLOAT FINISH MACHINE

[75] Inventor: Luiji Barichello, Modena, Italy

[73] Assignee: Barikell S.r.l., Modena, Italy

[21] Appl. No.: 256,893

[22] PCT Filed: Feb. 9, 1993

[86] PCT No.: PCT/EP93/00308

§ 371 Date: Jul. 28, 1994

§ 102(e) Date: Jul. 28, 1994

[87] PCT Pub. No.: WO93/16251

PCT Pub. Date: Aug. 19, 1993

[30] Foreign Application Priority Data

Feb. 13, 1992 [IT] Italy ..... MO92A0020

[51] Int. Cl.[6] ..... E01C 19/22

[52] U.S. Cl. ..... 404/96; 404/118

[58] Field of Search ..... 404/83, 85, 86, 404/96, 118–120, 113–114

[56] References Cited

U.S. PATENT DOCUMENTS 2,108,470 2/1938 Boulton ..... 94/45
3,791,754 2/1974 Zochil ..... 404/112
5,203,642 4/1993 Heller et al. ..... 404/96 X
5,221,156 6/1993 Martin ..... 404/97

FOREIGN PATENT DOCUMENTS 1525561 5/1968 France .
2502902 6/1976 Germany .

*Primary Examiner*—Michael Powell Buiz
*Attorney, Agent, or Firm*—Albert C. Smith; Rajiv P. Patel

[57] ABSTRACT

A float finish machine includes a rotor with a disk supporting a set of trowel blades, accommodated in corresponding radial slots, that are angularly adjustable with respect to the rotor about axes that are substantially parallel to the floor. The machine includes an engine and a speed reducer having an output shaft with a sliding collar positioned thereon. An idle spacing element, having a hub that is ensheathed by a sleeve, and that is rotatably coupled with the shaft through the sliding collar, has a diameter greater than the disk and is positioned on the shaft to freely rotate about the axis of the shaft. The sleeve operates in conjunction with a device for setting the angular position of the trowel blades.

15 Claims, 7 Drawing Sheets

FLOAT FINISH MACHINE

The invention concerns a machine for floating floors, that is to say, an assemblage of devices by means of which to effect an automatic smoothing action on extensive flat surfaces consisting in a layer of concrete or mortar, not yet fully dried; once hardened, such surfaces will provide floors in premises destined for industrial or commercial activity, for example, or in public or private buildings generally.

The prior of art comprises float finish machines comprising a rotor, or a pair of rotors each equipped with a set of adjustable radial trowel blades cantilevered from a crosswise supporting member driven in rotation about its own vertical axis by an engine and speed reducer.

The German document DE-A-2 502 902, for instance, discloses a float finish machine for floating floors, comprising a rotor consisting of a disk, disposed sustantially parallel to the floor, the disc being provided with radial slots each accommodating a trowel blade, each trowel blade being angularly adjustable about an axis disposed sustantially parallel to the floor, the disc being coupled with a shaft having its axis disposed substantially perpendicular to the floor. This document forms the basis for the preamble of the independent claim. One notable problem experienced with such machines is that of finishing the areas of the floor adjacent to the walls; this is due principally to the large outer diameter of the rotors, typically around one meter and even more, which dictates that the crosswise supporting member must maintain a stable horizontal position in order to ensure that its radial arms are protected from damaging vibrations and excessive shock loads. Such machines are therefore unsuitable for finishing the border areas of floors, albeit only slightly uneven or sloping, with the result that recourse must be made to the more costly operation of floating by hand.

It often happens, moreover, particularly with single rotor machines, that in an attempt to finish the border areas of a floor exhibiting a shallow depression, the operator will attempt to tilt the vertical axis of the rotor toward the wall; this results in excessive stress being placed on the arms of the crosswise supporting member and uneven wear on the mechanical components of the machine, not to mention damage to the areas of the wall against which the frame of the machine is caused to chafe.

The prior art thus stands in need of considerable improvement, in view of a possible elimination of the drawbacks mentioned above.

The object of the invention is to provide a float finish machine for floating floors of cement mortar or other suitable cement compound for industrial premises and public or private buildings, which is not affected by vibrations and/or heavy mechanical stresses on the rotor assembly and is suitable in particular for finishing the borders of a floor, even when the floor exhibits slightly concave or sloping areas; moreover, such a machine should not cause damages to the walls during operation and must also be functional, efficient and inexpensive.

The float finish machine according to the invention comprises a rotor consisting of a disk, disposed sustantially parallel to the floor, the disc being provided with radial slots each accommodating a trowel blade, each trowel blade being angularly adjustable about an axis disposed sustantially parallel to the floor, the disc being coupled with a shaft having its axis disposed substantially perpendicular to the floor wherein an idle spacing element having an outer diameter greater than the outer diameter of the disk is disposed on the shaft.

The profile of each radial slot is advantageously rectangular with the longer sides parallel to a radial direction; the respective trowel blade, having an outline corresponding to the profile of the slot, is rigidly connected to a shaft rotatably supported to the shorter sides of the slot in an intermediate position.

The disk is coupled by means of a central flange to vertically disposed shaft, driven by an engine through a speed reducer, an axially slidable cylindrical collar being coupled to said vertical disposed shaft in a position between said speed reducer and said central flange, the top end of said slidable cylindrical collar being coupled to an outer coaxial sleeve in such a way the sleeve is allowed to rotate, but is prevented from sliding axially, with respect to the collar, said sleeve exhibiting an annular projection engageable from above by the forked end of a forked lever designed to adjust the angular position of the trowel blades by displacing axially the sliding collar and the coaxial sleeve, the other end of the forked lever being hinged to a bottom end of a tie rod, said tie rod being inclined with respect to a vertical axis and being movable along its own axis.

The bottom end of the sliding collar is equipped with a further annular projection designed to transmit downward uniformly to the top ends of a set of crank levers a thrust applied to the forked lever, each crank lever being secured to the radially innermost end of a shaft supporting a trowel blade.

The machine also comprises a idle spacing element having a hub rotatably coupled to the outer surface of the sliding collar and interposed between said outer surface and the innner surface of the outer coaxial sleeve, the outer diameter of the spacing element being greater than the outer diameter of the disk supporting the trowel blades so as to prevent contact between the disk and the walls of the room when the machines works the border areas of a floor.

The advantages afforded by the present invention are: markedly higher quality of the float finish, especially over slightly uneven or sloping floor areas near the walls, said higher quality being achieved mainly by virtue of the reduced vibration to which trowel blades are subjected when supported at both ends; reduced mechanical stresses on the rotor; preventing damages caused by impacts of the frame of the machine against the walls of the room where the floor is laid; uniform wear on mechanical components; reasonable cost.

Some preferred embodiments of the invention are illustrated, strictly by way of example, in the seven accompanying sheets of drawings, in which.

Figure 1:
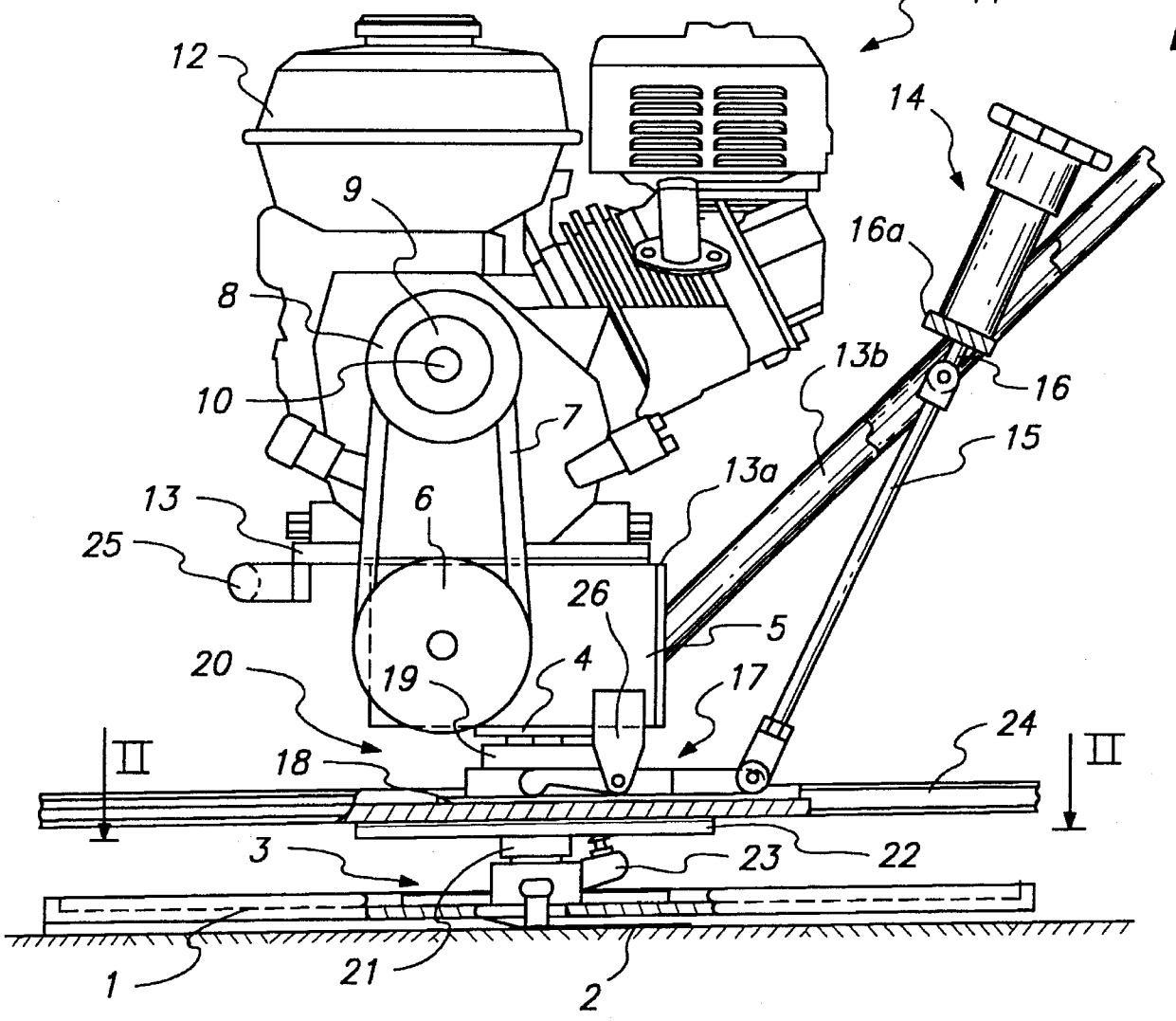
FIG. 1 is a side elevation, interrupted and partly cutaway, of a float finish machine according to the invention.

In the drawings, 1 denotes a horizontal disk supporting a plurality of radially disposed trowel blades 2, each angularly adjustable, the disk being carried by a flange 3 keyed to a vertical shaft 4 coupled to and driven by a speed reducer 5; the speed reducer is driven by a belt drive comprising a driven pulley 6 connected to the input shaft of the speed reducer, a belt 7 and a driving pulley 8 afforded by a clutch assembly 9 with centrifugal weights keyed to the crankshaft 10 of an engine 11 mounted above. 12 denotes the fuel tank of the engine 11, and 13 a bottom flange of the engine crankcase, which is secured to the top face 13*a* of the speed reducer 5 beneath.

13*b* denotes a pair of shafts extending upward and back from the rear face of the speed reducer casing, the top ends of which are joined to a handlebar (not illustrated) by which the machine is manoeuvred, and to which the main operating controls are mounted.

14 denotes a device for setting the angular position of the trowel blades 2, comprising an angled tie rod 15 having a topmost end pivotably connected to an adjustment screw 16 rotatable in such a way as to vary the longitudinal position of the rod 15 and thus vary the angle between the blades 2 and the surface of the floor. The screw 16 turns in a thread afforded by a cross member 16*a* interconnecting the angled shafts 13*b*. The bottom end of the tie rod 15 is pivotably connected to the rear end of an oscillating lever 17 fashioned with a forked forward end, said forked end being designed to apply a pressure to an annular projection 18 afforded by the bottom end of a sleeve 19 coaxially mounted on the rotor shaft 4 and rotatably coupled with a coaxial internal sliding collar 21 slidably coupled with the rotor shaft.

22 denotes a further annular projection extending radially from the bottom of the sliding collar 21, said annular projection being designed to transmit and distribute a thrust exerted by the forked forward end of the rocking lever 17 to the top ends of a plurality of crank levers 23 each keyed to a radially innermost end 23*a* of a respective shaft 23*b* supporting a respective trowel blade 2, said blade being fastened to a flat bottom face 23*c* of a shaft 23*b*.

24 denotes an idle spacing element having a peripheral surface coated advantageously with a resilient shock-absorbent material and a hub 24*a* interposed between the inner surface of the sleeve 19 and the outer surface of the sliding collar 21 and rotatably coupled to the sliding collar.

The outer diameter of the idle spacing element 24 is greater than the outer diameter of the disk 1 carrying the trowel blades 2, so as to ensure that the peripheral surface of the disk is prevented from entering into contact with the walls at the sides the floor.

25 denotes a handle secured to the forwardmost surface of the speed reducer 5, used for the purpose of lifting and transporting the machine, and 26 denotes one of a pair of lugs extending downward from the sides of the speed reducer 5, to which the forked arms of the oscillating lever 17 are hinged at an intermediate position.

Figure 2:
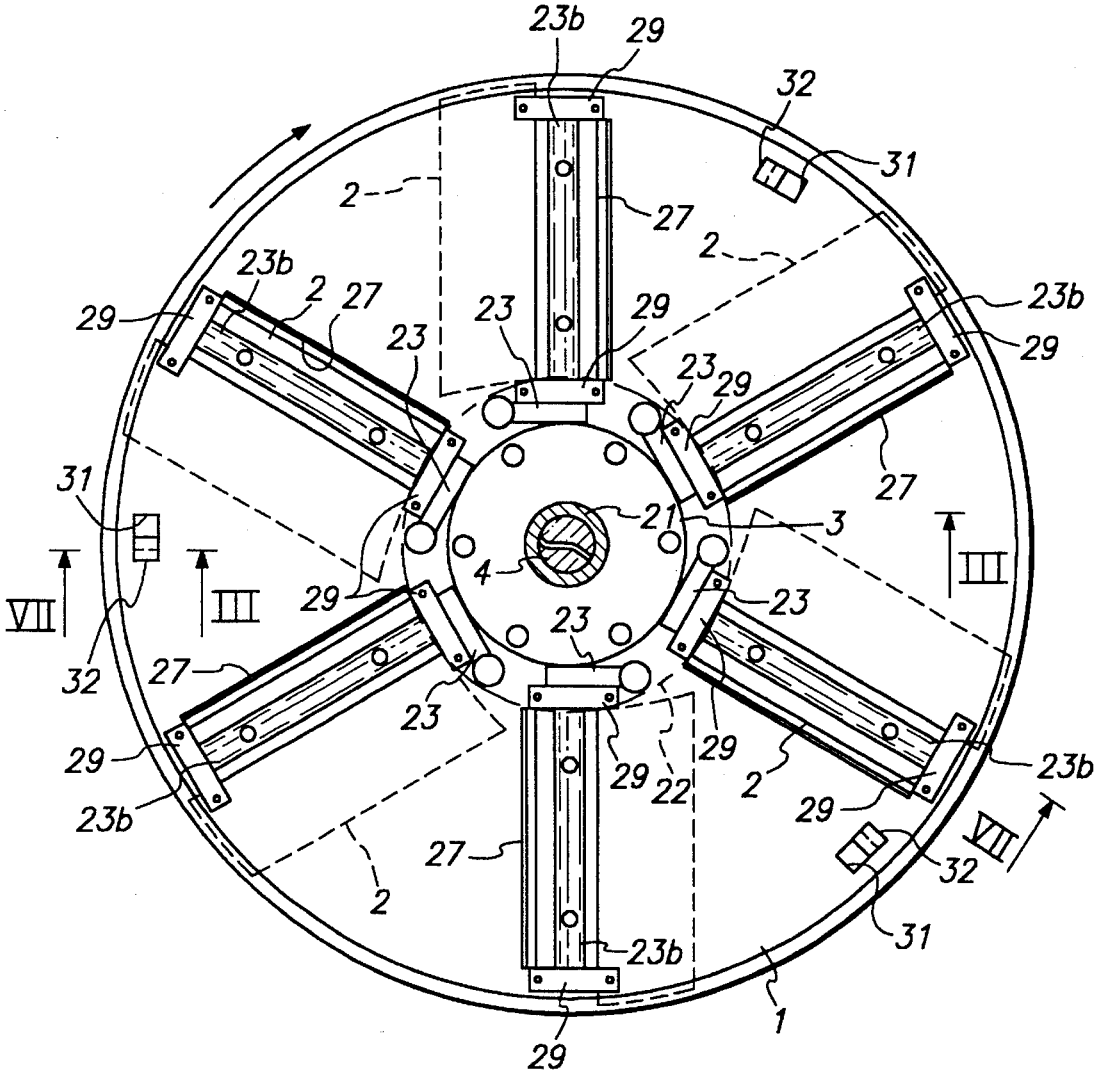
FIG. 2 is a section through II—II in FIG. 1.
Figure 3:
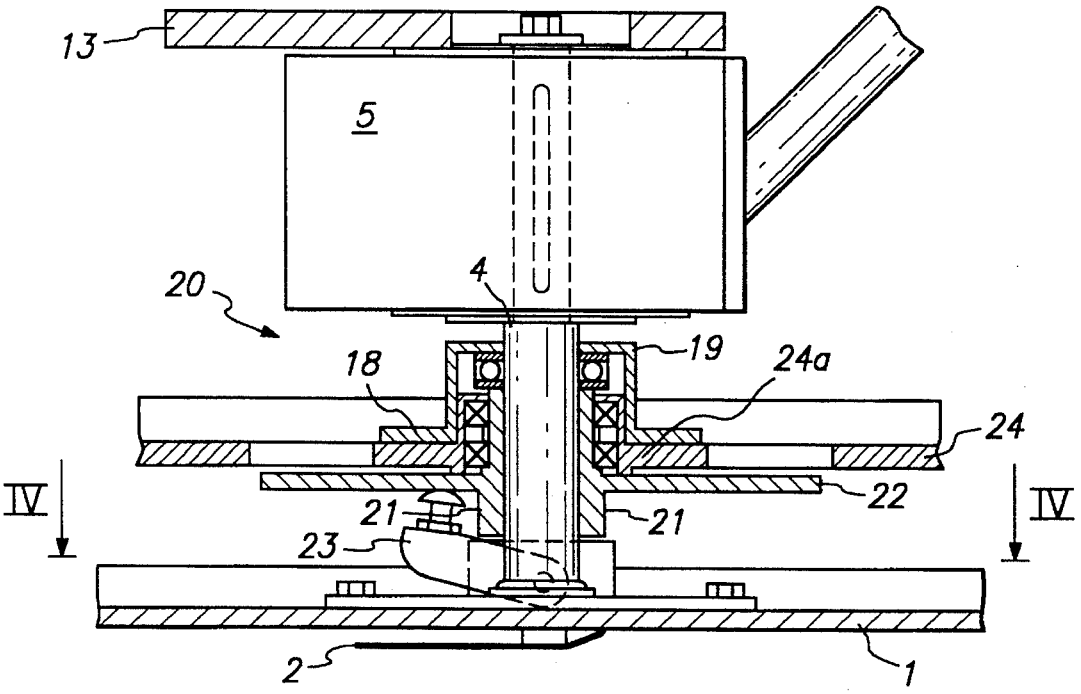
FIG. 3 is a longitudinal section through III—III in FIG. 2, showing the machine only in part and on a larger scale.

27 denotes a slot of a formation of radial through slots (FIG. 2) carrying the trowel blades 2, each appearing rectangular when viewed in plan, said slots being advantageously spaced apart at an angular distance for example of between 45° and 90° approximately.

Each radial slot 27 has a length advantageously greater than the half of the radius of the disk 1, and a width sufficient to admit and accommodate the articulating movement of a forward edge 28 of a corresponding trowel blade 2, the forward edge being angled slightly upward so as not to catch in the surface of the floor.

Figure 4:
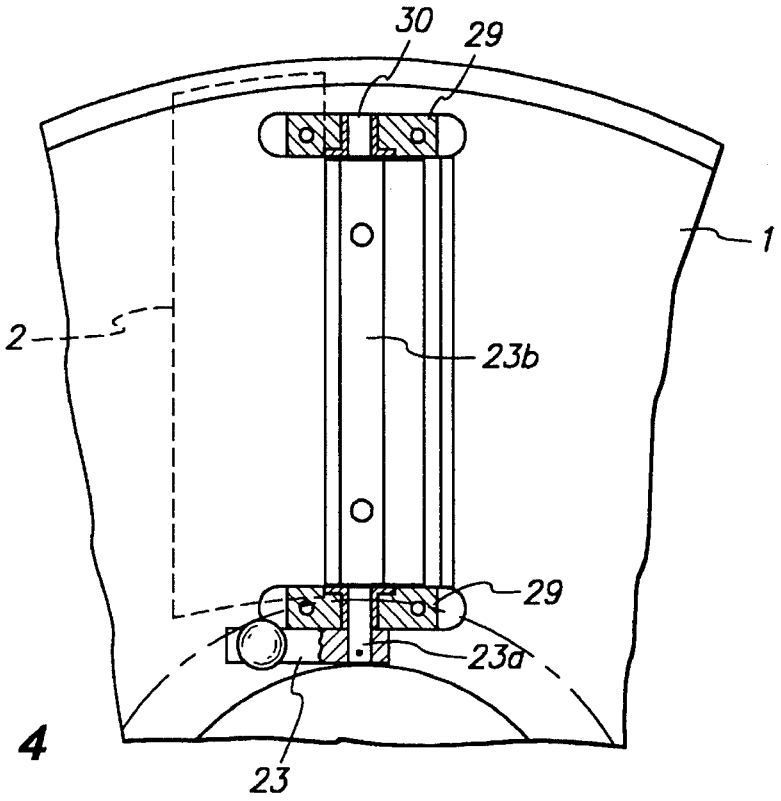
FIG. 4 is a section through IV—IV in FIG. 2, showing the machine only in part and on a larger scale.
Figure 5:
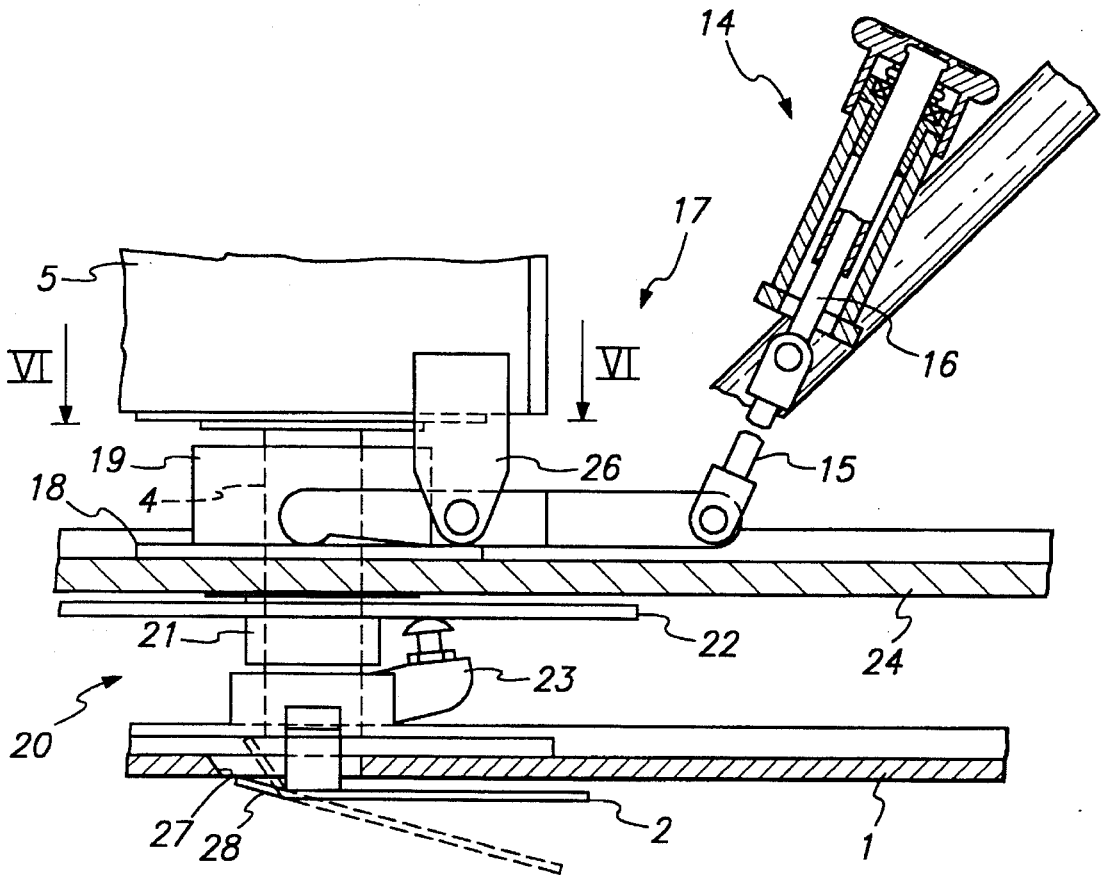
FIG. 5 is a partial and interrupted side elevation of a device designed to adjust the angular position of the trowel blades, shown partly in section, and on a larger scale.
Figure 6:
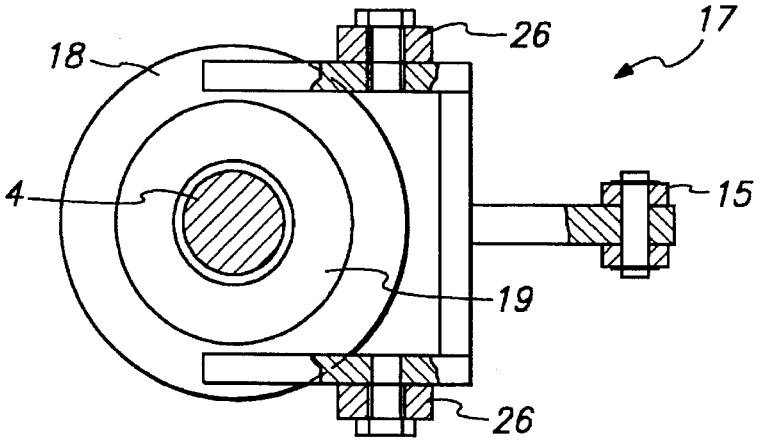
FIG. 6 is a cross section through VI—VI in FIG. 5.
Figure 7:
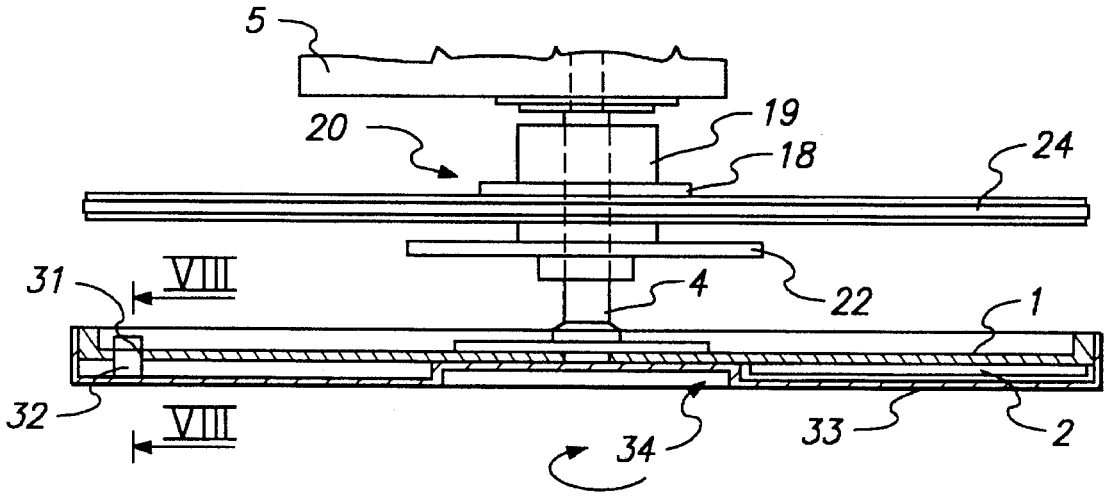
FIG. 7 is a partial, interrupted longitudinal section through VII—VII in FIG. 2, illustrating an embodiment of the machine equipped with a roughing tool.

29 denotes the bearings (FIG. 4) rotatably supporting the ends of each trowel blade 2, said bearings being secured to the top face of the disk adjacent to the shorter sides of each radial slot 27 and destined to accommodate the radially inner and outer ends 23*a* and 30 of a shaft 23*b*.

Figure 8:
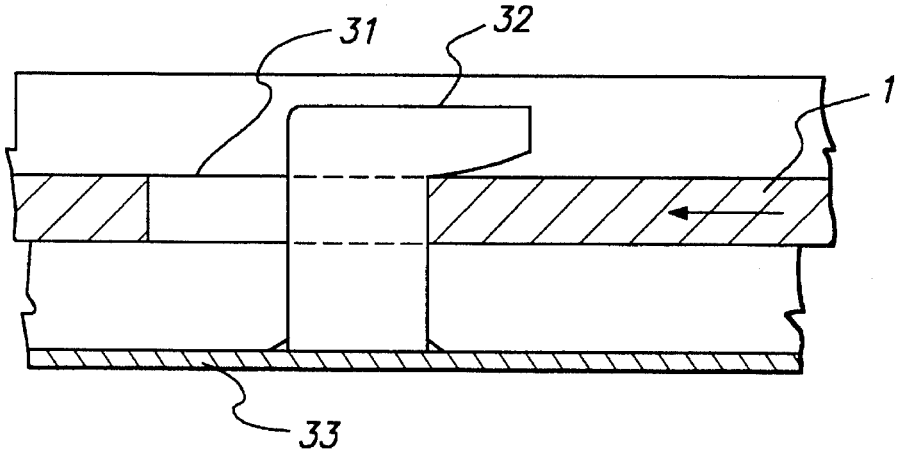
FIG. 8 is a section through VIII—VIII in FIG. 7, seen on a larger scale.

31 denotes a plurality of slots (FIG. 8) located in regular formation around the periphery of the disk, at an angular distance of 120° for example, designed to receive a corresponding plurality of angled catch pin elements 32 projecting rearwards with respect to the direction of rotation of the disk 1 and projecting upward from the top surface of a roughing tool 33, said roughing tool being shaped as a disk affording and being fitted to the disk 1 from beneath.

34 denotes a central cavity in in the working surface of the roughing tool designed to prevent the portions of the tool revolving at a peripheral velocity insufficient for roughing purposes from entering into contact with the floor: preferably, the cavity 34 has radius less than the radius of the disk 1.

Figure 9:
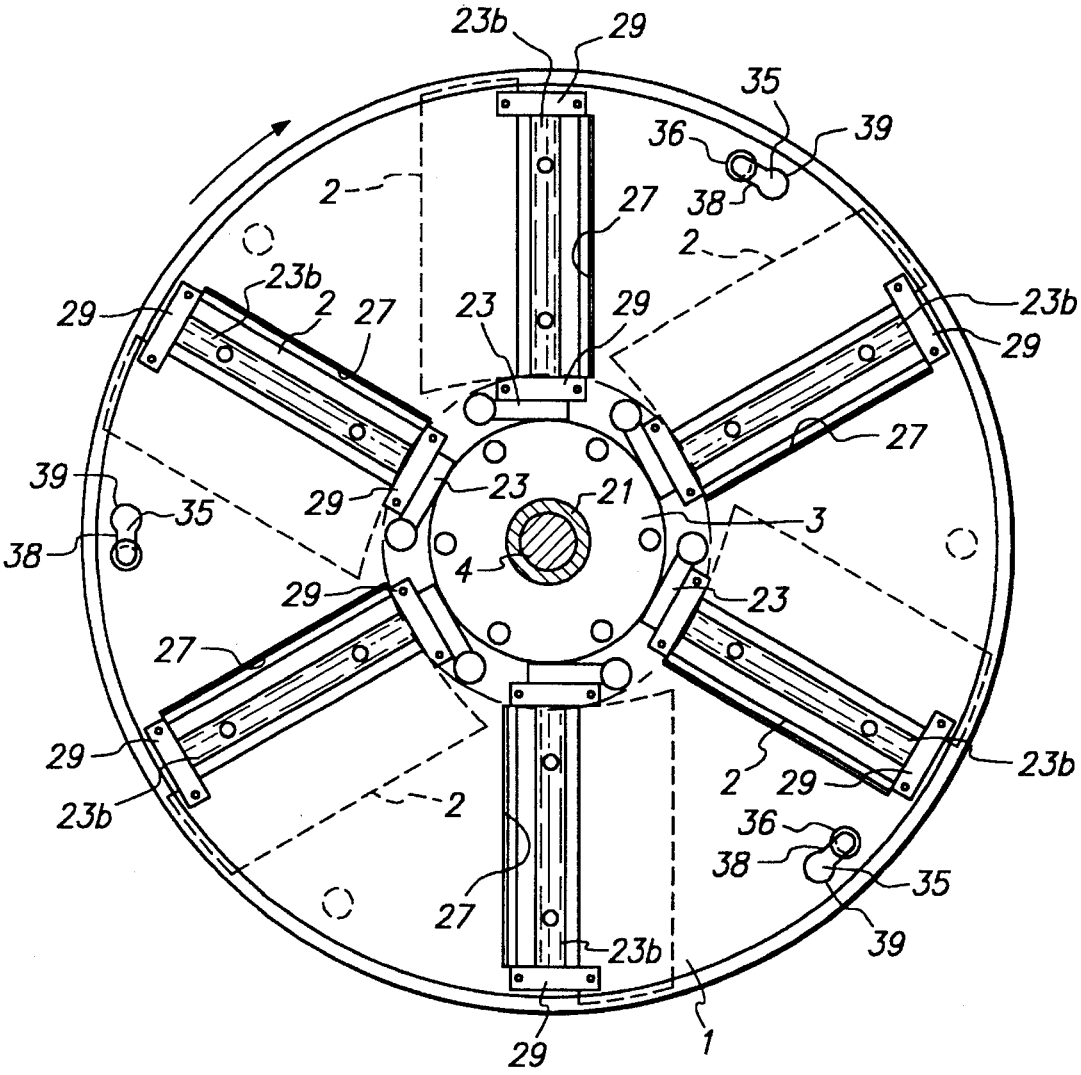
FIG. 9 is a section as in FIG. 2, which illustrates an alternative method of fitting a roughing toll.
Figure 10:
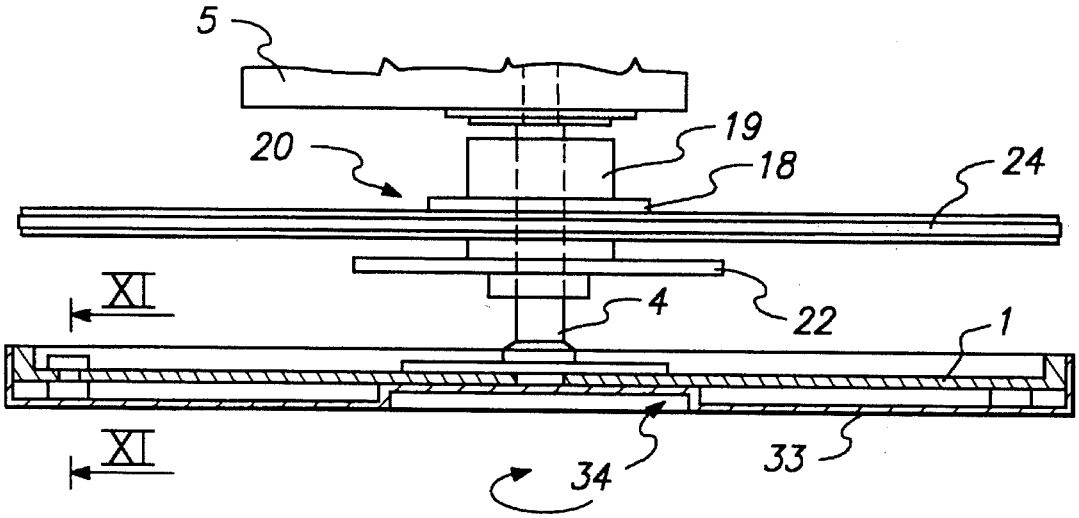
FIG. 10 is a section as in FIG. 7, also illustrating the alternative method of fitting a roughing tool.
Figure 11:
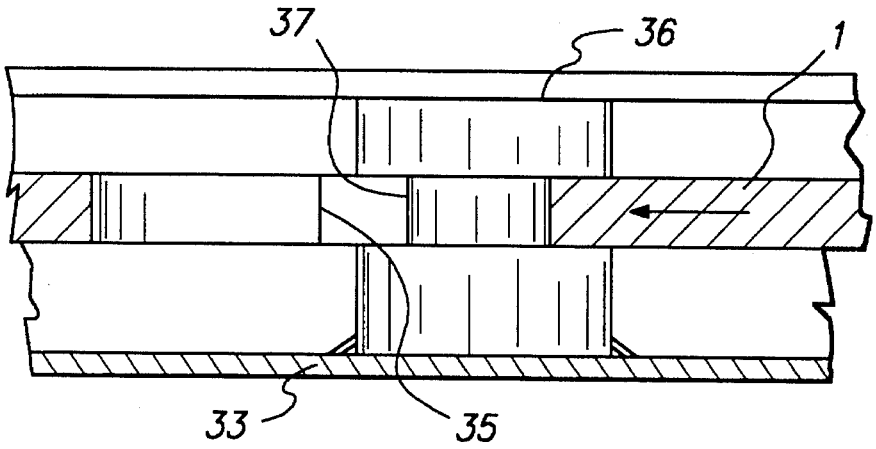
FIG. 11 is a section through XI—XI in FIG. 10.

35 denotes a plurality of slots (FIG. 9) located in regular formation around the periphery of the disk at an angular distance of 120° for example, designed to receive a corresponding plurality of substantially cylindrical retaining catch pin elements 36 projecting upward from the top surface of the roughing tool 33, each catch pin element exhibiting an intermediate portion 37 of reduced diameter. Each slot 35 comprises a first stretch 38 of width sufficient to accommodate the intermediate portion 37 of the retaining element 36 with a degree of clearance, followed in the direction of rotation of the disk 1 by a second stretch 39 of greater width able to accommodate the cylindrical element 36 in its entirety, likewise with a degree of clearance.

Operation of the machine is as follows: having selected the prescribed angle of contact between the bottom face of the trowel blades and the surface of the floor, by turning the adjustment screw 16 so as to raise or lower the tie rod 15 and thus determine the required angular position of the oscillating lever 17 and the corresponding axial position of the sliding collar 21, the engine 11 is started, thereby activating the clutch 9, the belt and pulley drive 6, 7, 8 and the speed reducer 5, and ultimately the rotor shaft 4 and the disk 1 with the trowel blades. When passing the machine over the border areas of the floor, the outermost edge of the disk 1 is prevented from rubbing against the skirting walls by the idle spacing element 24. To advantage, if the machine is fitted with a roughing tool 33, the outer diameter of the idle spacing element 24 will be greater than the outer diameter of the tool.

I claim:

1. A float finish machine for floating floors, comprising a rotor including a disk, disposed substantially parallel to the floor, the disk being provided with radial slots each accommodating a trowel blade, each trowel blade being angularly adjustable with respect to a plane of the rotor about an axis disposed substantially parallel to the floor, the disk being coupled with a shaft having its axis disposed substantially perpendicular to the floor, with an idle spacing element, having a hub coupled rotatably with the rotor, said idle spacing element having an outer diameter greater than the outer diameter of the disk positioned upon the shaft, being free to rotate about the axis of the shaft.

2. A machine as in claim 1, wherein each blade is fixed to the flat bottom face of a respective shaft disposed substantially parallel to the floor, said respective shaft having each end rotatably supported by the disk at an intermediate position on a shorter side of the slots.

3. A machine as in claim 2, wherein the shaft is provided with driving means and with a sliding collar disposed with an annular projection.

4. A float finish machine for floating floors, comprising a rotor including a disk, disposed substantially parallel to the floor, the disk having radial slots each accommodating a trowel blade, each trowel blade being angularly adjustable with respect to a plane of the rotor, each trowel blade being fixed to the flat bottom face of a respective shaft about an axis disposed substantially parallel to the floor, said respective shaft having each end rotatably supported by the disk at an intermediate position on a shorter side of the slots, the disk being coupled with a shaft having its axis disposed substantially perpendicular to the floor, with an idle spacing element having an outer diameter greater than the outer diameter of the disk positioned along the shaft parallel to the floor, said idle spacing element being free to rotate about the axis of the shaft, the shaft is provided with driving means and with a sliding collar disposed with an annular projection, said sliding collar is rotatably coupled with said idle spacing element, said idle spacing element having a hub ensheathed by a sleeve capable of axial movement as one with the sliding collar while rotatable in relation thereto, said sleeve affords an annular projection co-operating with a device for setting the angular position of the trowel blades, said device for setting the angular position of the trowel blades comprises a forked oscillating lever engaging said angular projection, said forked oscillating lever being pivotably connected to one end of a tie rod having a second end pivotably connected to an adjustment screw.

5. A machine as claimed in claim 3, wherein said sliding collar is rotatably coupled with said idle spacing element, said hub of said idle spacing element ensheathed by a sleeve capable of axial movement as one with the sliding collar while rotatable in relation thereto.

6. A machine as in claim 5, wherein said sleeve affords an annular projection co-operating with a device for setting the angular position of the trowel blades.

7. A machine as in claim 6, wherein said device for setting the angular position of the trowel blades comprises a forked oscillating lever engaging said annular projection, said forked oscillating lever being pivotably connected to one end of a tie rod having a second end pivotably connected to an adjustment screw.

8. A machine as in claim 6, wherein the annular projection of said sliding collar engages a plurality of crank levers, each crank lever being keyed to one end of a respective horizontally disposed shaft.

9. A machine as in claim 1, wherein said disk is provided with a flat roughing tool exhibiting a profile matched substantially to that of the disk when viewed in plan, the flat roughing tool disposed with a central cavity.

10. A machine as in claim 9, wherein the flat roughing tool is provided with a set of catch pin elements engaging corresponding slots of the disk.

11. A machine as in claim 10, wherein, with the exception of the slots for engaging the roughing tool, the disc has no apertures between the radial slots.

12. A machine as in claim 10, wherein the catch pin elements are angled rearwardly with respect to the direction of rotation of the disk.

13. A machine as in claim 10, wherein the catch pin elements are substantially cylindrical in shape and are provided with an intermediate portion of reduced diameter.

14. A machine as in claim 13, wherein each slot comprises a first stretch having a width greater than the diameter of intermediate portion of the catch pin element but less than the diameter of the catch pin element, said first stretch being followed in the direction of rotation of the disk by a second stretch having a width greater than the diameter of the catch pin element degree of clearance.

15. A machine as in claim 1, wherein the profile of the single trowel blade, viewed in cross section, appears substantially laminar with an upwardly angled forward edge.

* * * * *